US006962205B1

(12) United States Patent
Lay, Jr.

(10) Patent No.: US 6,962,205 B1
(45) Date of Patent: Nov. 8, 2005

(54) SUBSEA WELLHEAD LANDING CLAMP AND SLIP BOWL ASSEMBLY

(76) Inventor: Milford Lay, Jr., P.O. Box 1537, Morgan City, LA (US) 70381

( * ) Notice: Subject to any disclaimer, the term of this patent is extended or adjusted under 35 U.S.C. 154(b) by 36 days.

(21) Appl. No.: 10/377,075

(22) Filed: Feb. 28, 2003

(51) Int. Cl.[7] ..... E21B 33/038; E21B 19/00; E21B 17/02

(52) U.S. Cl. ..... 166/368; 166/382; 166/77.52; 166/342; 166/241.6; 166/379; 166/75.13; 166/85.1; 175/423

(58) Field of Search ..... 175/423, 325.5, 175/325.6, 325.7; 166/381, 382, 368, 341, 166/355, 342, 360, 339, 340, 343, 348, 379, 166/75.11, 93.1, 94.1, 75.13, 85.1, 88.2, 241.6, 166/241.7, 77.51, 77.52

(56) References Cited

U.S. PATENT DOCUMENTS 1,899,273 A * 2/1933 Hinderliter ..... 166/85.1
3,260,270 A * 7/1966 Watkins et al. ..... 137/15.08
3,625,282 A * 12/1971 Bridges et al. ..... 166/97.1
4,209,066 A * 6/1980 Watson ..... 166/377
4,428,433 A * 1/1984 Watkins ..... 166/339
5,031,695 A * 7/1991 Cain et al. ..... 166/75.14
5,318,385 A * 6/1994 Goulart et al. ..... 405/195.1
5,579,854 A * 12/1996 Barry ..... 175/57
6,095,242 A * 8/2000 Lequang et al. ..... 166/88.2

* cited by examiner

*Primary Examiner*—Jennifer H Gay
(74) *Attorney, Agent, or Firm*—Jesse D. Lambert

(57) ABSTRACT

A clamp for supporting a subsea wellhead and attached casing string preparatory to installing same in a well, and slip bowl assembly for running a drill pipe cementing string inside the casing string. The clamp comprises two hinged together clamp halves with a connector to permit the clamp to be locked about a subsea wellhead. Half-circle cutouts in each clamp half form a clamp bore when the clamp is closed. The clamp bore has a grooved profile to mate with a grooved profile on the exterior of the subsea wellhead. When the subsea wellhead is clamped in place, with the clamp resting on the rig floor, a slip bowl assembly having a grooved base plate is placed atop the clamp.

6 Claims, 2 Drawing Sheets

SUBSEA WELLHEAD LANDING CLAMP AND SLIP BOWL ASSEMBLY

BACKGROUND

1. Field of Art

This invention relates to apparatus used in the drilling of earthen boreholes, commonly called "wells," from floating drilling vessels. With further specificity, this invention relates to apparatus used in connection with the deployment of subsea wellheads, the protection of critical sealing areas thereon, and the placement and cementing of the associated casing string.

2. Related Art

Onshore or in shallow offshore waters, wellhead equipment is situated so as to be fairly close to (although nearly always somewhat below) the level of the rig floor. In particular, on offshore wells in water shallow enough that a bottom-supported, jackup type drilling rig can be used, a length of conductor casing extends upwardly from the sea floor, and helps support the wellhead which is generally mounted on the surface casing string, above the surface of the water a desired distance. The production "tree" (a multiple valve assembly) is therefore situated above the water level. A similar wellhead arrangement is used when wells are drilled by a platform drilling rig from a drilling/production platform.

In deeper waters, however, floating drilling rigs (either semi-submersible rigs or drillships) must be used. Here, the wellhead is situated on or near the sea floor and is therefore often referred to as a "subsea wellhead." For the illustrative purposes of this description, it will be assumed that the subsea wellhead is connected to the surface casing string. The blowout preventer ("BOP") stack clamps around, and effects a pressure and fluid seal with, the wellhead. Typically, a grooved profile in the bore of the BOP stack engages a similarly shaped, mating profile on the exterior of the subsea wellhead. Pressure integrity is typically achieved by a metal-to-metal seal between a seal area in the subsea wellhead, usually a beveled area around the inner circumference and near the top edge of the subsea wellhead (often referred to in the industry as the "AX bevel"), and a similar profile within the BOP stack bore. It can be appreciated that maintenance of the pressure seal between the BOP stack and the wellhead is of crucial importance to maintaining control of the well. In addition, if and when the subsea well is completed, a subsurface tree clamps to the wellhead and (like the BOP stack) must effect a pressure seal therebetween.

Critical to creating and maintaining this pressure seal is the beveled seal area on or near the upper edge of the subsea wellhead. This is generally a highly polished profile that must be protected during handling of the wellhead, lest it be scarred or otherwise damaged. If damaged, repairs can be very expensive, in addition to the rig downtime which must be incurred for the repair. In short, there are tremendous economic incentives to protect the subsea wellhead seal area.

However, the usual operations associated with running the subsea wellhead and surface casing string, and cementing the surface casing string, create numerous opportunities for damage to the subsea wellhead seal area. For illustration only, a typical sequence of operations will now be described.

One of the first steps in drilling a subsea well is running of "conductor pipe" (which is usually either drilled or jetted into place, and is typically 30" in diameter), and landing same with a subsea guide assembly in place on the sea floor.

The surface hole (typically 26" in diameter) is then drilled to the setting depth for the surface casing string (which for illustration may be considered as 20" casing), typically to a depth of about 2000" below the sea floor. The 20" surface casing string is then run down through the 30" conductor (the joints of the 20" casing string joined by either threaded or welded connections) until the last joint (save for the partial or full joint usually made up to the subsea wellhead beforehand, which will be referred to as the "landing joint") is disposed in the casing "spider," which is resting on the rotary table of the rig.

The next series of operations involves picking up the subsea wellhead along with its connected landing joint, and connecting that combined wellhead and landing joint to the remainder of the surface casing string. Then, the subsea wellhead must be lowered to a position substantially at the level of the rig floor, and supported there, while a length of drill pipe—the "cementing string"—is run inside the surface casing string to near its lower end. The subsea wellhead running tool (typically a cam actuated tool which engages a grooved profile in the subsea wellhead bore) is then latched into the subsea wellhead, and the entire assembly—that is, the subsea wellhead, the surface casing string, and cementing string—is lowered into the borehole on the drill pipe and the subsea wellhead is landed in the guide assembly on the sea floor. The surface casing is then cemented in place.

This description of operations identifies the need for an apparatus adapted to be disposed on the rig floor, to suspend the subsea wellhead and surface casing string therefrom, and which additionally provides a means for supporting drill pipe slips (and the weight of the cementing string) in order to run the cementing string inside of the surface casing. Prior art apparatus which sought to address these needs comprised a large two-piece circular clamp, each of the two pieces forming a half-circle. The two half-circles were placed around the subsea wellhead, then bolted together, typically with three nut and bolt assemblies per side. A grooved profile in the clamp bore engaged the grooved profile on the exterior of the subsea wellhead. The clamp could then be set upon the rig floor, thereby suspending the subsea wellhead and surface casing. Next, a circular plate having a diameter sufficient to span the diameter of the clamp bore was placed atop the clamp. This plate had a U-shaped cutout from its center to an edge, to permit it to be removed from around the drill pipe; however, no provision was made to prevent the plate from moving side to side on the clamp. A drill pipe slip bowl was then placed atop the plate, and the cementing string was then run in conventional manner with the slips.

This prior art apparatus presented several problems and drawbacks. First, bolting and unbolting the two halves of the clamp was time consuming and posed an increased risk of injury to rig workers. Second, the drill pipe slip bowl was not secured to prevent side-to-side movement within the subsea wellhead, since it was simply resting atop the base plate; therefore, particularly with the rocking movement often present on a floating drilling rig, the drill pipe cementing string was subject to striking the inner wall of the subsea wellhead bore, and more importantly to striking and damaging the bevel seal area of the subsea wellhead. The attendant potentially tremendous direct and indirect costs resulting therefrom are readily appreciated.

What is needed, therefore, is an apparatus which is adapted to quickly and safely engage the subsea wellhead to suspend the wellhead and the surface casing string from the rig floor, and thereafter to quickly and safely disengage from the subsea wellhead. Further, the apparatus should comprise a drill pipe slip bowl assembly which is held securely centered within the subsea wellhead bore, thereby centering the cementing string within the subsea wellhead bore, and minimizing (if not eliminating) the possibility of the cementing string damaging the seal area of the subsea wellhead.

SUMMARY OF THE INVENTION

The present invention comprises a hinged, split clamp having a bore profile adapted to engage the exterior profile of the subsea wellhead and thereby permit the subsea wellhead to be suspended from the rig floor. The clamp comprises two clamp halves hinged together on one side, each with a substantially half-circle cutout therein. A connector is disposed on the opposite side of the two clamp halves, and is of a design which may be readily engaged and disengaged. When the two clamp halves are in a closed position, a circular bore is formed, and the hinge and the connector permit the clamp to be readily opened and closed about the subsea wellhead. The circular bore of the clamp has a grooved profile adapted to engage the grooved profile on the exterior of the subsea wellhead, and thereby permit suspending the subsea wellhead and casing string from the rig floor. The clamp, in the closed position, is adapted to support a slip bowl assembly comprising a base plate and a drill pipe slip bowl, commonly referred to as an "API bowl," into which drill pipe slips may be set during the running of the drill pipe cementing string. The slip bowl assembly is split to permit it to be placed around and removed from around a length of drill pipe.

DESCRIPTION OF THE PRESENTLY PREFERRED EMBODIMENT

While those skilled in the art will recognize different embodiments as being possible while not exceeding the scope of the present invention, the following description will illustrate some of the presently preferred embodiments of the invention.

Figure 1:
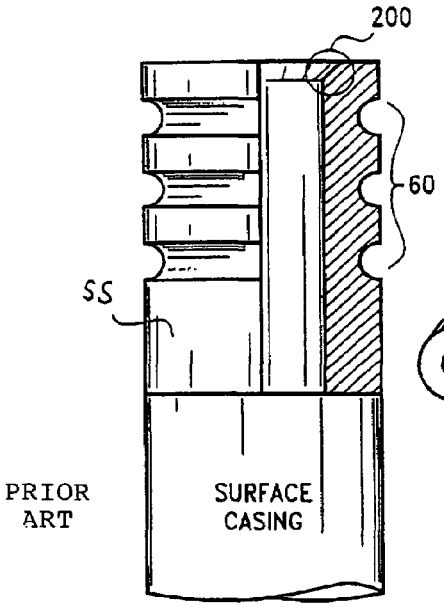
FIG. 1 shows a typical subsea wellhead in partial cross-section, connected to a joint of surface casing.
Figure 2:
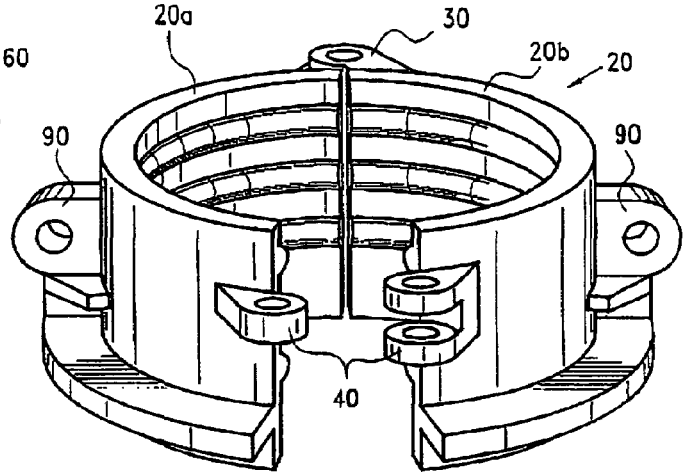
FIG. 2 is a perspective view of the clamp in an open position.
Figure 3:
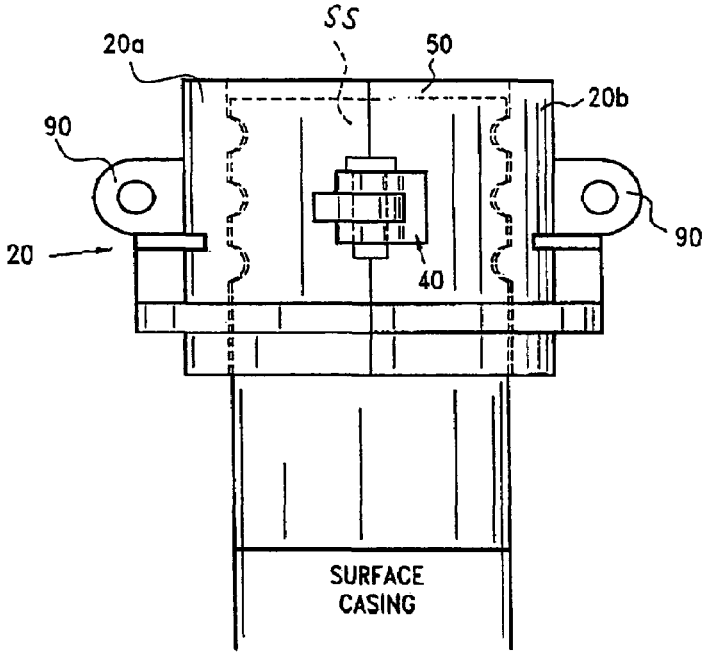
FIG. 3 is a partial cross-section view of the apparatus in a closed position about a subsea wellhead.

Referring to FIGS. 1–6: FIG. 1 shows a typical subsea wellhead SS attached to a section of surface casing. The apparatus 10 of the present invention comprises a hinged clamp 20 comprising two clamp halves 20*a* and 20*b*, each having a substantially half-circle cutout therein. Clamp 20 has a hinge 30 about which clamp halves 20*a* and 20*b* may rotate, between open and closed positions. FIG. 2 is a perspective view of clamp 20 in an open position. A fastener 40 joins clamp halves 20*a* and 20*b* together in the closed position. In the closed position, the half circle cutouts form a circular bore 50. In a presently preferred embodiment, fastener 40 comprises two pairs of aligned ears having holes therethrough, through which a pin can be placed to lock the ears, and consequently clamp halves 20*a* and 20*b*, together, as best seen in FIG. 3.

As seen in FIGS. 2 and 3, circular bore 50 is grooved and adapted to match and closely engage with outer profile 60 of a subsea wellhead SS, as shown in FIG. 1. FIG. 3 is a view of the apparatus in a closed position and clamped about a subsea wellhead SS. It can be readily seen that the engagement of the mating profiles will permit clamp 20 to carry the weight of subsea wellhead SS along with the surface casing, as later described in more detail.

In the presently preferred embodiments, lift eyes 90 are provided on either side of clamp 20, preferably one on each of clamp halves 20*a* and 20*b*. Lift eyes 90 may be used to lift clamp alone, or to lift clamp 20 along with subsea wellhead SS (including with its joint of casing attached thereto).

Figure 4:
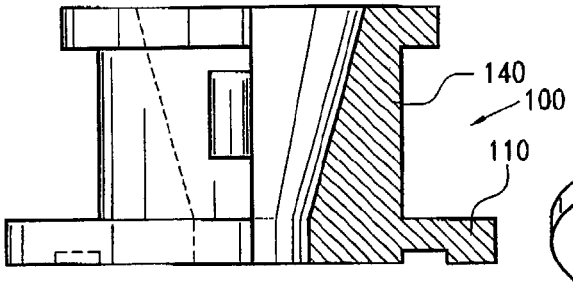
FIG. 4 is a partial cross section view of the slip bowl assembly.
Figure 5:
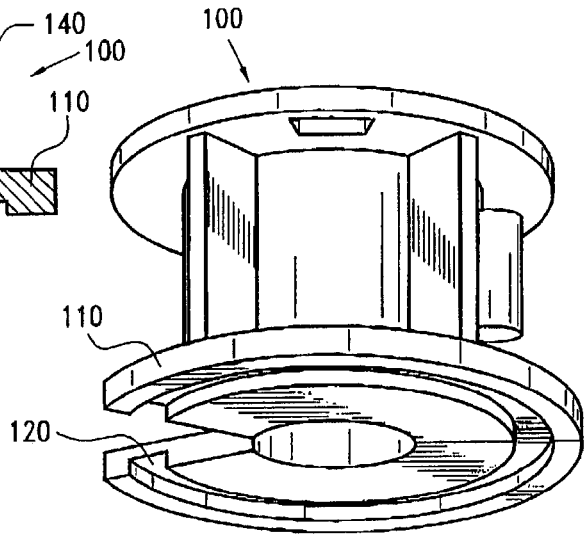
FIG. 5 is a perspective view showing the grooved bottom of the base plate.
Figure 6:
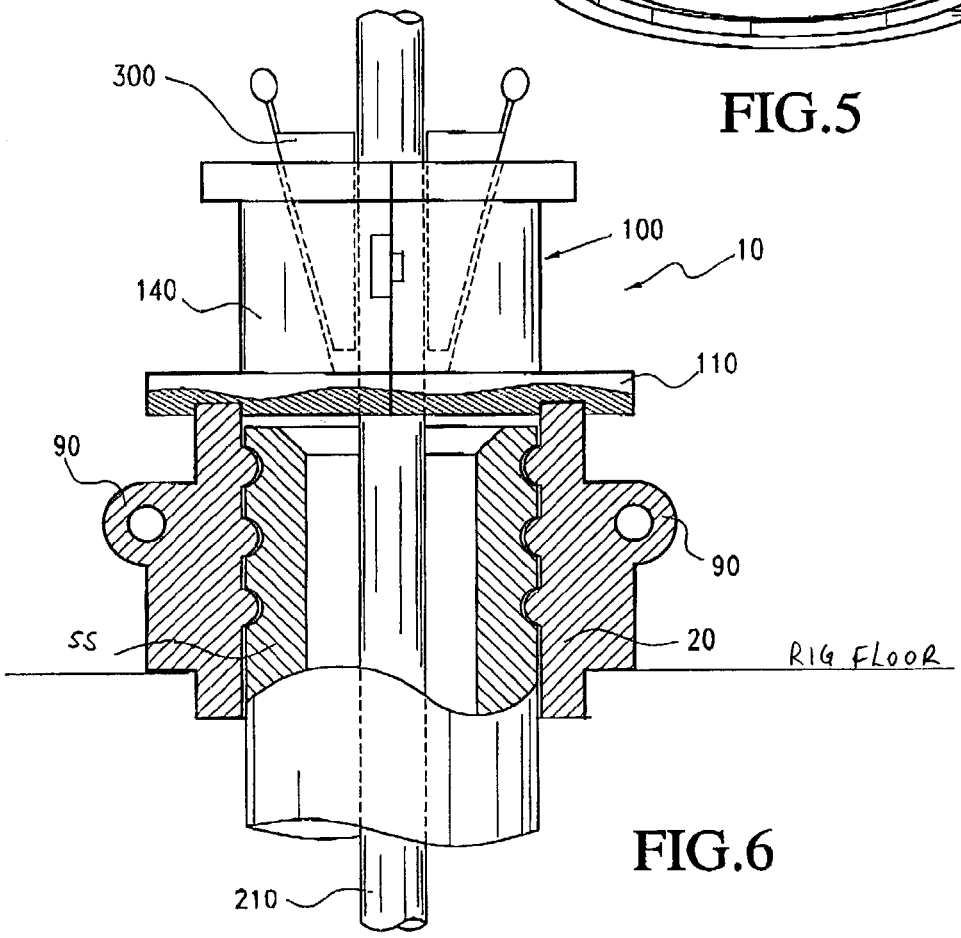
FIG. 6 shows the slip bowl assembly in place atop the clamp, with a section of drill pipe run therein.

Turning to FIGS. 4–6, the present invention may further comprise slip bowl assembly 100, adapted to fit atop clamp 20 when clamp 20 is in a closed position, with subsea wellhead SS clamped therein, to permit running of the drill pipe cementing string as is later described. Slip bowl assembly 100 comprises a base section 110 which has a circumferential groove 120 on its lower surface which fits over the upper circumferential lip of clamp 20. Base section 10 spans the opening of bore 50 of clamp 20. Bowl 140 is disposed on base section 10, and is of a standard drill pipe slip bowl configuration (commonly called an "API bowl") to receive drill pipe slips. Slip bowl assembly 100 is "split," in that it is comprised of two substantially like halves which are pinned together, permitting it to be removed and replaced around a length of drill pipe situated therein.

A typical sequence of use of the invention will now be described, commencing once the surface casing string has been run and the last joint (save for the joint or partial joint made up to the subsea wellhead) is resting in the casing spider. Clamp 20 is placed about subsea wellhead SS, which typically (although not necessarily) has an already-attached landing joint, and connector 40 locks the clamp in place. Clamp 20 will serve to protect subsea wellhead SS. Subsea wellhead SS is then picked up, either by slings attached to lift eyes 90 on clamp 20, or by the subsea wellhead running tool which engages an inner profile within the subsea wellhead. Subsea wellhead SS and the attached landing joint is brought to the position such that the final casing connection may be made. Next, as best seen in FIGS. 3 and 6, subsea wellhead SS along with the surface casing string is lowered until clamp 20 rests on the rig floor, and clamp 20 therefore suspends the subsea wellhead and surface casing string assembly.

Typically, the next operation involves the running of the drill pipe cementing string down inside of the surface casing string. Referring to FIG. 6, slip bowl assembly 100 (which is split, so that it can be put in position or removed even while a drill string is in place) is set atop clamp 20. It can be readily seen that circumferential groove 120 prevents slip bowl assembly 100 from moving side-to-side, and consequently prevents the drill string from striking the bevel seal area 200 of the subsea wellhead. Cementing string 210 is then run down within subsea wellhead SS and the surface casing string to a desired depth (typically near the bottom of the surface casing string). Drill pipe slips 300 set in slip bowl assembly 100. Upon reaching the desired depth, slip bowl assembly 100 may be removed, a subsea wellhead running tool engaged within subsea wellhead SS, and the entire surface casing string and subsea wellhead assembly lowered to its ultimate resting position with subsea wellhead SS in place in the guide assembly on or near the sea floor.

With regard to dimensions, clamp 20 and slip bowl assembly 100 may be made to dimensions well known in the art, to accommodate subsea wellhead SS, drill pipe slips, etc. As is further well known in the art of oilfield equipment of this nature, suitable materials for the invention generally comprise various metal alloys.

While the preceding description sets forth many details of the invention, same are offered in order to illustrate some of the presently preferred embodiments and not by way of limitation. Those skilled in the relevant art field will recognize that numerous changes may be made without departing from the spirit of the invention. For example, dimensions and materials may be varied to suit particular situations. On the clamp, lift eye shapes and positions may be altered. The hinge may be provided with a removable hinge pin, so that the two clamp halves may be completely separated if needed. The particular shape of the slip bowl assembly may be altered, as long as the slip bowl assembly maintains its positioning within the clamp to avoid side-to-side movement.

Therefore, the scope of the invention should be measured not by the examples given above, but by the scope of the appended claims and their legal equivalents.

What is claimed is:

1. Apparatus for running subsea wellheads, comprising:

a) a clamp comprising two hinged together clamp halves, movable between open and closed positions, each clamp half having a substantially semi-circular cutout therein so that when said two clamp halves are in said closed position a circular bore is formed, said circular bore having a plurality of rounded circumferential ridges which are sized and shaped to match and fit within grooves of a grooved profile of the exterior surface of a subsea wellhead; and b) a lock disposed on said clamp to hold said two clamp halves locked in said closed position.

2. The apparatus of claim 1, further comprising a lift eye disposed on each of said clamp halves.

3. The apparatus of claim 1, wherein said lock comprises a pair of aligned ears on each of said clamp halves, said ears comprising holes therethrough, and a pin, whereby when said clamp halves are in said closed position said pin may be inserted through said holes, thereby locking said clamp halves together.

4. The apparatus of claim 2, wherein said lock comprises a pair of aligned ears on each of said clamp halves, said ears comprising holes therethrough, and a pin, whereby when said clamp halves are in said closed position said pin may be inserted through said holes, thereby locking said clamp halves together.

5. Apparatus for running subsea wellheads, comprising: a) a clamp comprising two hinged together clamp halves, movable between open and closed positions, each clamp half having a substantially semi-circular cutout therein so that when said two clamp halves are in said closed position a circular bore is formed, said circular bore having a grooved profile adapted to engage a grooved ile of the exterior surface of a subsea wellhead;

b) a lock disposed on said clamp to hold said two clamp halves locked in said closed position; and c) a slip bowl assembly disposed atop said clamp when said clamp is in said closed position, said slip bowl assembly comprising a base section having a lower surface with a circumferential groove therein, said circumferential groove adapted to engage an upper surface of said clamp and thereby prevent side-to-side movement of said slip bowl assembly on said clamp, said slip bowl assembly further comprising a slip bowl disposed on said base section, said slip bowl configured to accommodate a set of drill pipe slips, and wherein said slip bowl assembly comprises at least two pieces so that it may be placed around and removed from a section of drill pipe contained therein.

6. A combined subsea wellhead clamp and slip bowl assembly, comprising:

a) a clamp comprising two hinged together clamp halves, movable between open and closed positions, each clamp half having a substantially semi-circular cutout therein so that when said two clamp halves are in said closed position a circular bore is formed, said circular bore having a grooved profile adapted to engage a grooved profile of the exterior surface of a subsea wellhead;

b) a lock comprising a pair of aligned ears on each of said clamp halves, said ears comprising holes therethrough, and a pin, whereby when said clamp halves are in said dosed position said pin may be inserted through said holes, thereby locking said clamp halves together;

c) a slip bowl assembly disposed atop said clamp when said clamp is in said closed position, said slip bowl assembly comprising a base section having a lower surface with a circumferential groove therein, said circumferential groove adapted to engage an upper surface of said clamp and thereby prevent side-to-side movement of said slip bowl assembly on said clamp, said slip bowl assembly further comprising a slip bowl disposed on said base section, said slip bowl configured to accommodate a set of drill pipe slips, and wherein said slip bowl assembly comprises at least two pieces so that it may be placed around and removed from a section of drill pipe contained therein.

* * * * *